US010598323B1

(12) United States Patent
Schaak

(10) Patent No.: US 10,598,323 B1
(45) Date of Patent: Mar. 24, 2020

(54) ILLUMINATED NOVELTY FRAME FOR DISPLAYING A FEATURE IN MOTION

(71) Applicant: ADESSO INC., New York, NY (US)

(72) Inventor: Lee Schaak, New York, NY (US)

(73) Assignee: ADESSO INC., New York, NY (US)

( * ) Notice: Subject to any disclaimer, the term of this patent is extended or adjusted under 35 U.S.C. 154(b) by 0 days.

(21) Appl. No.: 16/291,223

(22) Filed: Mar. 4, 2019

(51) Int. Cl.
*F21S 10/00* (2006.01)
*G09F 13/24* (2006.01)
*G09F 13/04* (2006.01)

(52) U.S. Cl.
CPC ..... *F21S 10/002* (2013.01); *G09F 13/0413* (2013.01); *G09F 13/24* (2013.01)

(58) Field of Classification Search
CPC ..... F21S 10/002; F21S 8/033; F21S 10/00; F21S 10/026; F21W 2121/00; F21W 2131/308; F21W 2131/30
USPC ..... 362/101
See application file for complete search history.

(56) References Cited

U.S. PATENT DOCUMENTS 3,387,396 A 6/1968 Smith
4,034,493 A 7/1977 Ball
4,196,899 A 4/1980 Patterson
5,778,576 A 7/1998 Kaviani
5,803,580 A 9/1998 Tseng
6,065,850 A * 5/2000 Chiu ..... A01K 63/003 362/101
6,135,604 A 10/2000 Lin
6,447,138 B1 * 9/2002 Yang ..... A63J 17/00 362/101
6,604,835 B2 8/2003 Zale
6,681,508 B2 * 1/2004 Unger ..... F21S 10/002 40/406
8,294,389 B2 * 10/2012 Finkle ..... F21S 6/005 362/101
8,695,247 B1 * 4/2014 Yang ..... G09F 13/32 362/101
2006/0291217 A1 * 12/2006 Vanderschuit ..... A63H 27/10 362/363
2009/0255155 A1 * 10/2009 James ..... G09F 19/02 362/101

OTHER PUBLICATIONS

"Silent Night LED Light Shadow Box", retrieved from bedbathandbeyond.com/store/product/silent-night-led-light-shadow-box/5187082?keyword=light-up-frame, printed Mar. 4, 2019 (prior art), 2 pages.
Volcano Lamp, published on or before Mar. 3, 2019 [retrieved on Dec. 1, 2019], 7 pages. Retrieved from the Internet: <URL:www.menkind.co.uk/volcano-lamp>.

* cited by examiner

*Primary Examiner* — William J Carter
(74) *Attorney, Agent, or Firm* — Leason Ellis LLP

(57) ABSTRACT

An illuminated novelty frame for displaying a feature in motion is disclosed, having a frame and two panels that are separated by a gap and seated within the frame. At least one of the panels is transparent, and each panel is supported by the frame at an interface. An electric motor is supported by the frame and when energized induces movement of a decorative feature that is positioned to move and be visible between the two panels. A light source, also supported by the frame, is oriented to illuminate at least the feature.

10 Claims, 6 Drawing Sheets

ILLUMINATED NOVELTY FRAME FOR DISPLAYING A FEATURE IN MOTION

FIELD OF THE INVENTION

The present invention relates to novelty displays involving objects in motion for the home or office that are both pleasing to everyday viewers as well as being conversation pieces.

BACKGROUND OF THE INVENTION

Most people will agree that it is relaxing to watch objects in motion such as disco balls or fish, to name just two examples.

For this reason and perhaps many others, liquid-filled novelties have long been a staple decoration in homes and offices. The liquid is often water, for reasons of its ready availability, its safety and handling properties, and the fact that a product incorporating water can often be shipped empty of water, instead requiring the end user to add it. It is also typically cheaper than other available liquids such as melted paraffin or any of the various oils. Examples of liquid-filled novelties include the perennial favorite snow globes as well as the '60s-iconic lava lamps, which have also acquired an enduring popularity.

The familiar and cozy snow globe or the groovy lava lamp may make for very appealing decorations to any space, but they also come with some of the same practical limitations as well as others that are unique to each. For example, the dimensions of both novelties will impose certain space requirements on the chosen display location. The base for both a snow globe and a lava lamp are most often circular, but when the additional space occupied by any associated protuberances such as switches or power cables is accounted for, it becomes a roughly square area that must be provided by the table or other available surface. This can represent a problem as it represents a sacrifice of either useful, functional tabletop or counter space, or else just space that most people would prefer to devote to family photos or a needed lamp. In the case of a snow globe, even though the liquid filling the globe is usually water, the globe will typically come filled with water both because of the problem of obtaining the faux snow as well as the fact that the decorative features disposed within snow globes are often delicate and would face the risk of damage if a user were to attempt to fill it with liquid. Regarding a lava lamp, this too comes filled with an oil along with wax, and it would not be desirable or even feasible, for the user to fill it himself. Clearly, in the cases of both the snow globe and the lava lamp, the products would for all practical purposes need to ship from the manufacturing site with all necessary liquid contained therein. This will impose additional shipping costs due to the excess weight caused by shipping liquid-filled novelty items.

Thus, it would be advantageous to provide a novelty item that can provide the viewing pleasure of a movable object while taking up far less space in the display location, having a lower gross weight due to the optional inclusion of liquid at shipment, and having greater ease of use and safety characteristics for the intended consumer.

SUMMARY OF THE INVENTION

The present invention satisfies all the above requirements and more. An illuminated novelty frame is provided containing a feature that provides visual stimulation both by its charming appearance and the fact that the feature is set in motion by action of components housed within its frame. The frame accommodates two panels that are separated by a gap, and at least one of the two panels is transparent to allow a clear view of the feature when the frame is hung upon or otherwise disposed against a wall. In one embodiment, the other panel can have a reflective surface, both for purposes of enhancing the visual effect of the feature as well as imparting a utilitarian, mirror function to the frame. Alternatively, both panels can be transparent, which may be advantageous when the intended display location is tabletop in the middle of a room, a counter, a dresser, etc., as conceivably all approaches and lines of sight may be possible. Furthermore, one or both of the panels can have a printed overlay to provide additional visual features to the display, such as an environmental backdrop.

The feature set in motion between the two panels can take a variety of forms. One possible aspect of the feature is the inclusion of water between the panels, which can be added by the user via a port on the frame. Each panel is joined to the frame at an interface, and in frames where the addition of water is desired, the interface forms a liquid-impermeable barrier. The invention includes a motor to provide motive force to any of the various features that are possible in the present invention. The motor is supported by the frame and connectable to an electric power source, and when energized induces movement of rotating or reciprocating machinery that can take the form of an air pump or other pneumatic device that can introduce a quantity of air into the liquid. Alternatively, the motor can be coupled to a shaft to cause directly coupled movement of the feature itself, or of another motion inducing apparatus, such as an impeller. In the case of an impeller, its motion in the volume of liquid between the panels establishes and directs currents within the liquid sufficient to induce movement of a feature suspended in the volume of liquid.

In one embodiment of the invention, the feature is made up of a multiplicity of glitter particles disposed between the panels and suspendable in a volume of liquid added between the panels. Further embodiments can have a multiplicity of white plastic particles disposed between the panels to simulate a snowstorm, or a multiplicity of tan or sand-colored plastic particles disposed between the panels to simulate a sandstorm in a desert environment. A multiplicity of reflective orange-colored plastic particles, combined with an appropriate printed panel overlay showing burning fireplace logs, can simulate a fireplace having a roaring fire throwing sparks when illuminated by an integral light source that is supported by the frame. The motor supported by the frame is energized to drive a flow inducing apparatus, such as an air pump connected to one or more nozzles in fluid communication with the volume of liquid between the panels. The nozzles introduce air into the liquid in patterns that can include continuous streams of air, streams of discrete bubbles, as well as more intermittent, and even larger, bubbles or boluses of air. The action of the bubbles causes a pleasing motion of the suspended glitter particles, both by means of the direct impact of rising bubbles with glitter particles, as well as by the currents established and directed by the streams or boluses of air being introduced into the volume of liquid by the air pump. In an alternative embodiment of the invention, the motion of the multiplicity of glitter particles can be established by an impeller acting as the flow inducing apparatus moving within the volume of liquid. The impeller is attached to the end of a drive shaft, and the motor is coupled to the other end of the drive shaft to provide the motive force for the impeller. Some propulsive force will be applied directly to a subset of the glitter particles as they fall to the bottom of the space and are hit by the impeller as it moves, but most of the glitter particles will be set in motion as they are carried along by the currents established by the impeller.

In another embodiment of the invention, the feature takes the form of an object freely floating in the liquid. The object can advantageously be made to resemble a fish or other form of aquatic life, a scuba diver, a submarine, or anything that one might expect to find fully submerged in a body of water. The action of the bubbles emitted from the nozzles and rising into the object will set it into motion, simulating intentional movements either by an aquatic life form, a scuba diver, or a submarine in response to the commands of its captain. The density of the object can be chosen to provide the desired behavior in response to the action and direction of incidence of the bubbles. In an embodiment having the air pump-connected nozzles disposed near the lower edges of the panels and in fluid communication with the volume of liquid, the object can be manufactured to have a greater density than the liquid between the panels so that the air injected in an upward direction will oppose the downward movement of the object due to the force of gravity acting on the object. An alternative embodiment, wherein the nozzles are disposed near the upper edges of the panels and in fluid communication with the volume of liquid, has the object manufactured to have a lower density than the liquid so that the air injected in a downward direction will oppose the upward movement of the object due to the force of buoyancy acting on the object. In both cases, the object's density and the flow pattern of the injected air will be selected to establish the proper force balance that will ensure optimal motion characteristics of the feature while avoiding undesirable results such as the object coming to rest near the lower edges of the panels or rising toward the upper edge of the panels and settling at the top of the frame.

The feature between the panels has a further embodiment that could be described as "the volcano." This feature requires the introduction of a quantity of globules, which can take the form of elastic, spheroid rubber balls. A sloped, substantially conical projection extends or rises from a base disposed within the frame between the two panels. The projection includes a mouth disposed near its top to simulate the volcano's vent, which is the fissure that expels lava during an eruption. In this arrangement, the output stream of at least one nozzle is positioned within the conical projection and directed such that its output stream axis or centerline extends through a point contained within the vent area, an area defined by the periphery of the mouth. If more than one nozzle is disposed within the projection, they can be positioned such that the respective stream axes extend through a variety of points within the vent area. A catch basin or a guide within the frame conducts quantities of the globules into the path of the one or more nozzles, causing the globules to be expelled through the mouth in a way that is reminiscent of a volcanic eruption. For example, a nozzle whose stream axis extends through a point at the geometric center of the vent area can simulate the effects of an explosive eruption that spews lava and ash into the atmosphere to high altitudes. Alternatively, the output stream from a nozzle whose stream axis extends through a point in the vent area near the periphery of the mouth will experience significant interference or flow impedance, simulating the visual effect of lava drizzling down the flanks of the volcano. One nozzle can be used, oriented to achieve the desired effect, or a plurality of nozzles may be disposed within the projection to achieve an effect that combines elements of both explosive eruption and flank drizzle. Alternatively, the motor can be connected by a shaft to a turbine or an impeller that creates an upward jet of water to expel the globules from the volcano. The catch basin is positioned within the frame to collect the globules as they fall within the volume of liquid under the influence of gravity, and it is formed to direct the collected globules into the output stream of the at least one nozzle. Alternatively, one or more guides can be positioned within the frame, each guide having a first end and a second end in fluid communication with the volume of liquid. The guide conducts globules collected at the first end, on the level of the base or in the catch basin, to the second end, whose output is directed into the output stream of the at least one nozzle or impeller disposed within the projection. An arrangement that combines a catch basin and one or more guides is also possible. In this embodiment, the one or more guides are connected in series between the catch basin and the output stream of the at least one nozzle.

A further embodiment of the present invention includes a shaft having a first end and a second end, with the motor is coupled to the first end of the shaft. When the motor is energized, it rotates the shaft, causing motion of a feature connected to the second end of the shaft. One from that the feature can take in a shaft-actuated embodiment of the invention is that of a mirror ball. When the mirror ball is rotated within the frame it will cast a kaleidoscopic display of dancing reflected light, an effect which can be further enhanced in the embodiment wherein one of the panels has a reflective surface. The mirror ball embodiment does not require the addition of a liquid between the panels to obtain a pleasing visual effect. However, depending on the specific form that the mirror ball, panels, and any other decorative features that can be disposed between the panels take, visual effects could be further enhanced by the addition of liquid between the panels.

A further shaft-actuated feature embodiment includes a volume of liquid between the panels and has the second end of the shaft opposite the motor output coupled to an impeller which when set in motion induces movement of a volume of liquid contained between the panels. The motion of the impeller creates currents in the liquid, resulting in a propulsive force on a feature that is suspended in the liquid. The feature can take the form of the multiplicity of glitter particles or the freely-floating object, both referred to earlier in the discussion of an air pump connected to at least one nozzle. The propulsive force and currents created by the impeller would be sufficient to keep the suspended glitter or object aloft against the force of gravity. In the case of a freely-floating object that is of lower density than the liquid between the panels, an impeller positioned near the top of the panels would exert a propulsive force to resist the upward force of buoyancy on the object.

Further features, aspects and advantages of the invention will be appreciated from the accompanying drawing figures and detailed description of certain embodiments of the invention.

BRIEF DESCRIPTION OF THE DRAWING FIGURES

FIG. 1. is a perspective view of an illuminated novelty frame for displaying a feature in motion according to a first embodiment of the present invention.

DETAILED DESCRIPTION OF CERTAIN EMBODIMENTS OF THE INVENTION

Figure 1:
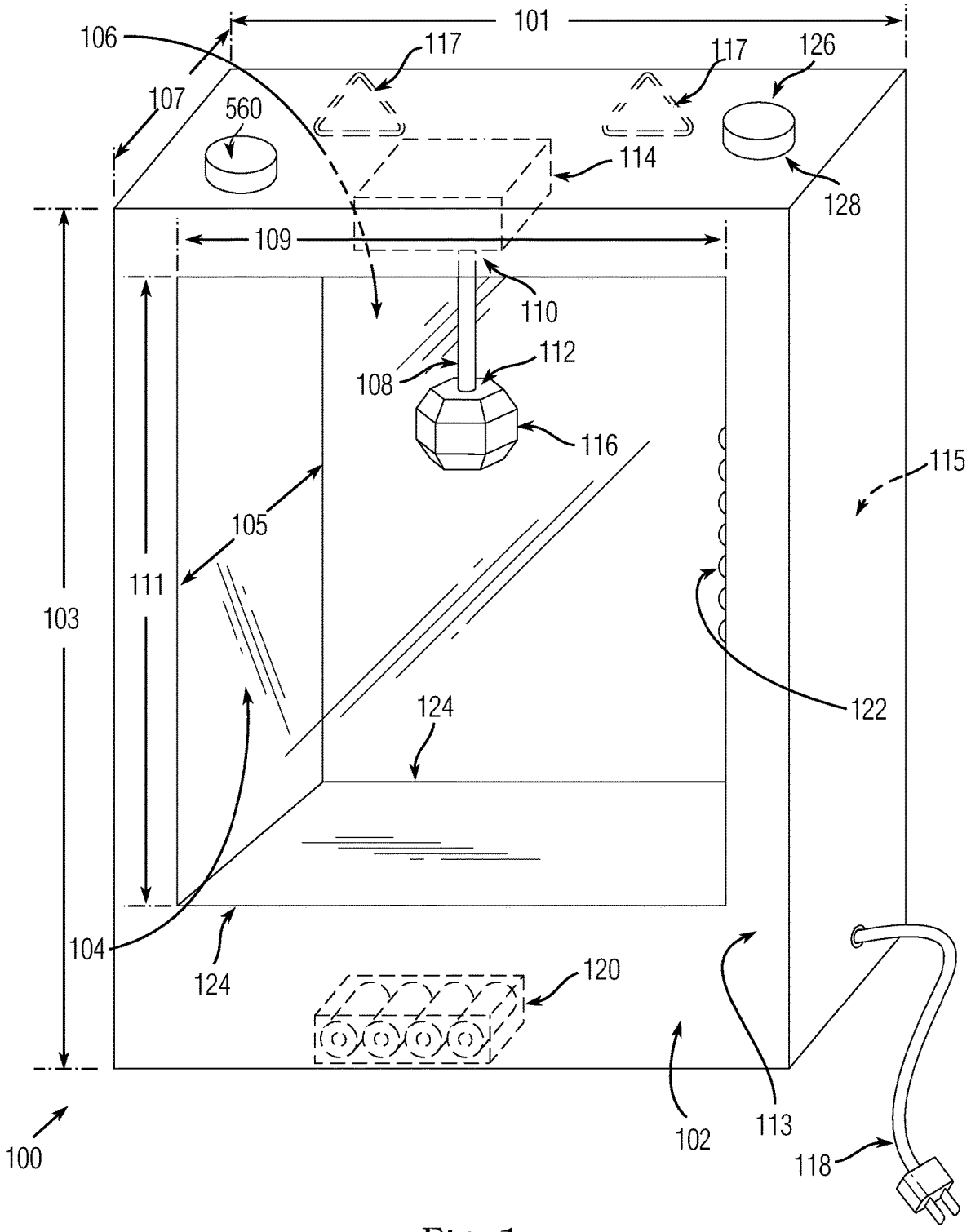

The following disclosure describes embodiments of an illuminated novelty frame for displaying a feature in motion. FIG. 1 is a perspective view of an embodiment of an illuminated novelty frame 100 according to the present invention. The frame 102 is made of a lightweight, but durable, plastic according to an embodiment of the invention, but any material that can securely support the component parts of the invention can be used. The frame 102 can be constructed of individual pieces that are melted or glued together, or alternatively, can be cast or molded as a unitary piece. Fasteners suitable to the chosen frame material can also be used to join separate frame pieces.

The frame can have a rectangular shape when viewed from the front, and a shallow depth, generally suitable for mounting on a wall or placement on a shelf. For instance, the width 101 and height 103 can be around eight inches while the depth 107 can be around 1.5 to 2.0 inches. Embodiments of the invention can have dimensions along these lines to approximate those of a thick picture frame. The two broad sides of the frame whose dimensions are the width and height of the frame 102 are referred to as the front face 113 and the back face 115. The frame also includes at least one aperture 117 disposed near the top edge of one of its faces 113, 115, centrally located with respect to the width of the face. The aperture 117 is adapted to receive a picture frame hanger, such as a nail or a hook, and allow the frame 102 to be hung upon a wall or other vertical surface. The frame can include more than one aperture 117, disposed near the top edge of at least one of the faces 113, 115, provided that the apertures 117 are arrayed symmetrically about the center of the face in the width-wise direction to balance the weight of the illuminated novelty frame 100.

The frame accommodates two panels 104, 106 of equivalent size that are seated within the frame and separated by a gap 105. The panels 104, 106 can be made of glass, but can be made of a lighter transparent material such as plastic or a high-tensile strength plastic. The panels have a width 109 and a height 111 sized to seat within the frame. Thus, for instance, the panels can have a width and height of around five to seven inches. A shaft 108, having a first end 110 and a second end 112, is shown extending from the frame 102 in the space between the two panels 104, 106. The first end 110 of the shaft 108 is attached to a motor 114 that is supported by the frame 102. When energized the motor 114 causes movement of a feature 116 attached to the second end 112 of the shaft 108. One form that the feature 116 can take in a shaft-actuated embodiment is that of a mirror ball which, when rotated within the frame 102, casts a kaleidoscopic display of dancing reflected light, an effect which can be further enhanced in an embodiment wherein one of the panels 104, 106 has a reflective surface. The motor 114 is connectable to any electric power source, for example, an AC power supply or a battery. A power cord 118 extends from the frame 102 in one embodiment of the invention, preferably from near the bottom of the frame 102, allowing connection to an AC power source such as a wall outlet or even a generator. A battery compartment 120 can also be supported by the frame 102 to provide power when an AC power source is not available, or if it is desired to produce an embodiment free of a cable. In a conventional manner, a power switch 560 can be used to turn the circuit on and off, and an optional timer circuit of conventional design can switch the unit off after a prescribed period of time. At least one of the two panels 104, 106 are transparent, to allow a clear view of the feature 116 when the novelty frame 100 is hung upon or otherwise disposed against a wall.

FIG. 1 also shows one possible light source 122 provided to illuminate the feature 116. The light source 122 is supported by the frame 102, and it is positioned and oriented to illuminate the feature 116 in a way that highlights its novel characteristics. The light source 122 in an embodiment is an LED array, but it can also be any other compact light source that is connectable to an electric power source, including a small incandescent bulb. Each of the panels 104, 106 are supported by the frame at an interface 124.

One possible aspect of the feature is the inclusion of water between the panels. The water is added by the user via a port 126, which optionally will have a cap 128 that engages with the frame 102 to provide a liquid-impermeable seal. In frames where the addition of water is desired, the interface 124 forms a liquid-impermeable barrier to define a volume of liquid within the gap 105 between panels 104, 106. In an embodiment, the interface 124 takes the form of a gasket to keep water contained between the panels. Alternatively, the interface 124 can form a liquid-impermeable barrier by having a durable adhesive disposed along the lines of contact between each panel 104, 106 and the frame 102. An additional possibility is having the panels 104, 106 snap-fit tightly enough into the frame 102 to form a liquid-impermeable barrier.

The mirror ball embodiment of the feature 116 does not require the addition of a liquid between the panels 104, 106 to obtain a pleasing visual effect. However, depending on the specific form that the mirror ball, panels, and any other decorative features that can be disposed between the panels take, visual effects could be further enhanced by the addition of liquid between the panels.

In one embodiment of the invention shown in FIG. 1, one of the two panels 104, 106 can have a reflective surface, both for purposes of enhancing the visual effect of the feature 116 as well as imparting a utilitarian, mirror function to the novelty frame 100. Alternatively, both panels 104, 106 can be transparent, which may be advantageous when the intended display location is tabletop in the middle of a room, a counter, a dresser, etc., as conceivably all approaches and lines of sight may be possible.

Figure 2:
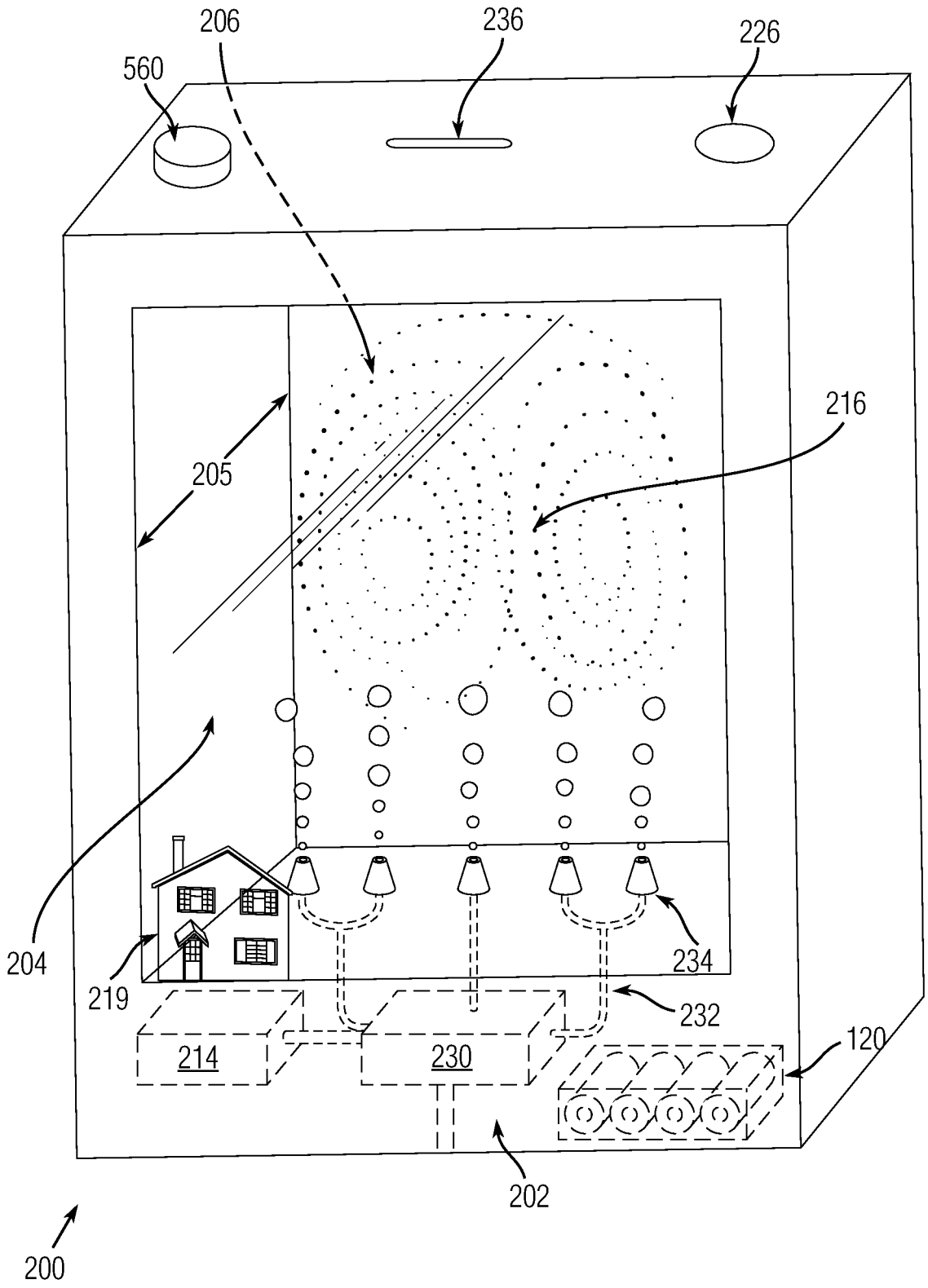
FIG. 2 is another perspective view of the illuminated novelty frame for displaying a feature in motion according to a second embodiment of the present invention.

An alternative embodiment of the invention 200 which requires the addition of a volume of liquid between the panels 204, 206 is shown in FIG. 2. The feature 216 of this embodiment can appropriately be referred to as "the glitter storm." The feature 216 in this embodiment is a multiplicity of glitter particles in the space 205 between the panels 204, 206, which are suspendable when a volume of water is added. The glitter can also be suspended in a volume of deionized water, oil, or other fluid within the space 205. An air pump 230 is supported by the frame 202 and driven by the motor 214. The discharge from the air pump 230 is fluidly connected by a manifold 232 to at least one nozzle 234 which provides fluid communication between the air pump 230 and the liquid between the panels 204, 206. When the motor 214 is energized, the resulting air discharge delivered through the one or more nozzles 234 induces movement of the feature 216 suspended in the liquid, which in this case is the multiplicity of glitter particles. The air streams, bubbles, or larger boluses emitted by the nozzles 234 establish currents in the water which carry the glitter particles along. Direct impacts with air bubbles will also impart motion to the glitter particles. The properties of the air stream can be controlled by the selected power and duration of air injection as well as by the selection of nozzle outlet size and shape. Because air is being introduced into the water-tight space 205 between the panels 204, 206, some means of venting the injected air from the novelty frame 200 must be provided. This can be accomplished either by leaving the port 226 open, or by providing at least one optional vent 236 in the frame, disposed near the top of the panels.

The context of the presentation in the embodiment 200 can employ an alternative multiplicity of particles in the space 205, such as to achieve "a snowstorm," by adding a multiplicity of white plastic particles instead of glitter to the water in the space 205 between the panels 204, 206. The panels 204, 206 can also have a printed overlay 219 applied to them that adds additional visual stimulation and provides context for the snowstorm feature 216 disposed between the panels 204, 206. A printed overlay 219 that can be used in embodiment 200 of the invention depicts a snow-covered house that enhances the illusion that one is observing a blizzard in progress. Another alternative context can be "a sandstorm," in which a multiplicity of tan or sand-colored plastic particles is added to the space 205 between the panels 204, 206 and in which a printed overlay showing a desert scene. A further alternative context to the second embodiment 200 can be "a fireplace," in which a multiplicity of reflective orange-colored plastic particles is added to the space 205 between the panels 204, 206 and combined with a printed overlay showing burning fireplace logs. When illuminated by an integral light source that is supported by the frame, the overall effect simulates a fireplace having a roaring fire throwing sparks.

Figure 3:
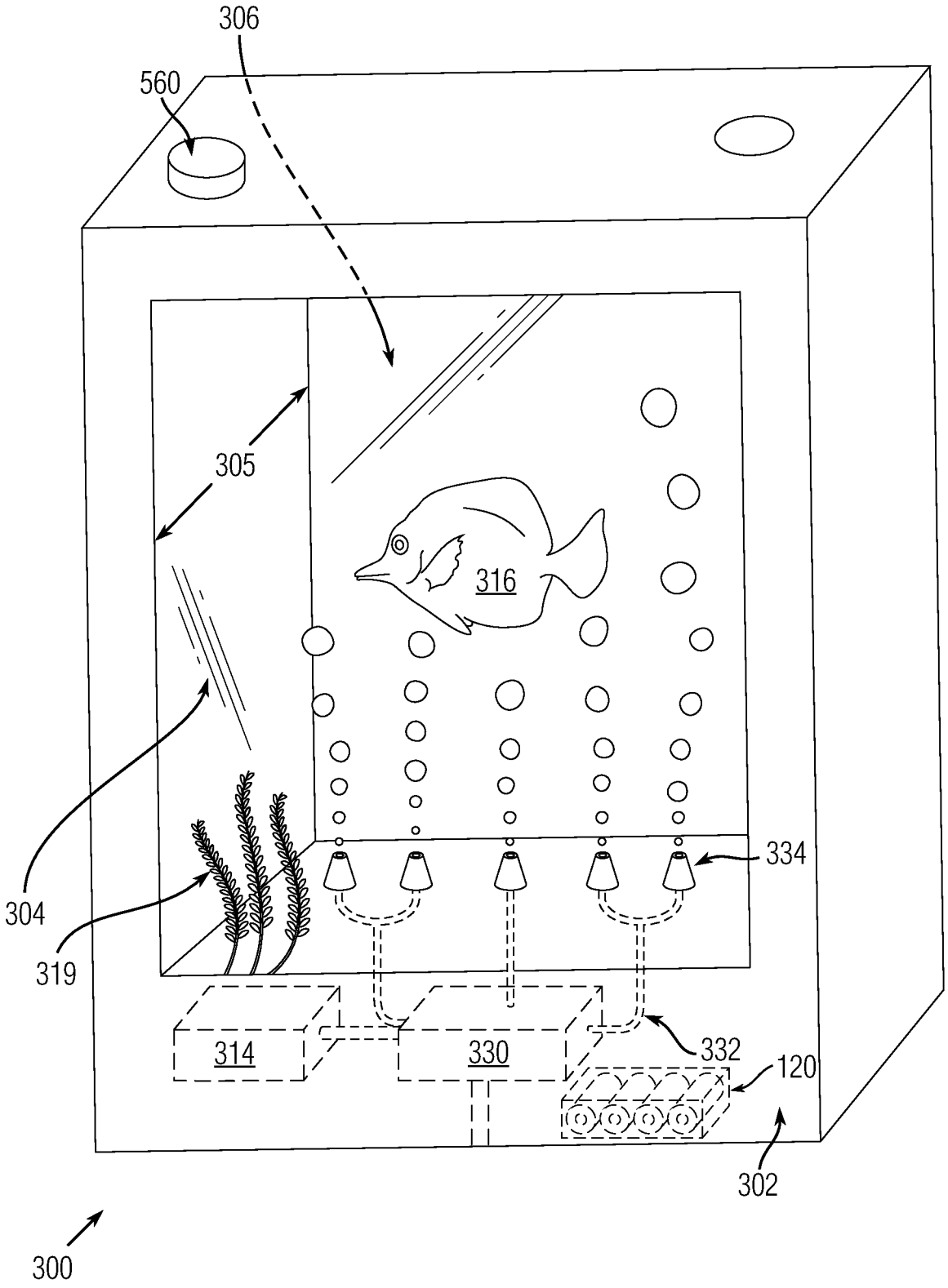
FIG. 3 is another perspective view of the illuminated novelty frame for displaying a feature in motion according to a third embodiment of the present invention.

An alternative embodiment of the invention 300 is shown in FIG. 3, a display that can appropriately be referred to as "the fish tank." The feature 316 in this embodiment is an object freely-floating in the liquid whose motion while suspended in the liquid is induced by the action of the at least one nozzle 334 fluidly connected to the air pump 330, and preferably several nozzles all receiving air from the air pump 330 by way of a manifold 332. The manifold distributes the air bubbles across the width of the space 305 to more reliably ensure continued movement of the object 316 during use of the novelty. The freely-floating object may preferably be formed in the likeness of a fish, a jellyfish, or any other aquatic life form, or even a scuba diver or submarine. A printed overlay 319 that can be used in embodiment 300 of the invention depicts seaweed and other aquatic plant life that enhances the illusion that one is observing marine biology in action. The air discharge through the nozzles 334 will exert a force on the object. Depending on the object's density relative to the density of the liquid, it will display a characteristic motion produced by the resultant force on the object. In one embodiment of the invention, the freely-floating object feature 316 will have a density greater than that of the liquid, ideally water. This will cause the object feature 316 to sink to the bottom of the volume of water under the influence of gravity in the absence of any motive force introduced by air discharge from the nozzles 334. When a stream of air bubbles is injected into the volume of water from the nozzles 334, a force balance can be achieved between the weight that maintains the object feature 316 suspended in a position midway between the top and bottom of the panels 304, 306 while mimicking the action of a living creature swimming.

An alternative embodiment of the invention has the object feature 316 made to have a density less than that of the liquid, preferably water. In this case, the buoyancy force exerted on the object feature 316 in an upward direction will counteract the weight of the object, causing it to rise to the top of the volume of water in the absence of any additional forces. The nozzles 334 are disposed within the frame 302 proximally to the upper edges of the panels 304, 306, directing the discharge of air downward toward the object feature 316. The input air volume can be set such that a force balance is achieved between the downward thrust force from the nozzles 334 and the upward buoyancy force exerted on the object feature 316. This force balance maintains the object feature 316 suspended in a position midway between the top and bottom of the panels 304, 306 while mimicking the action of a living creature swimming.

Figure 4:
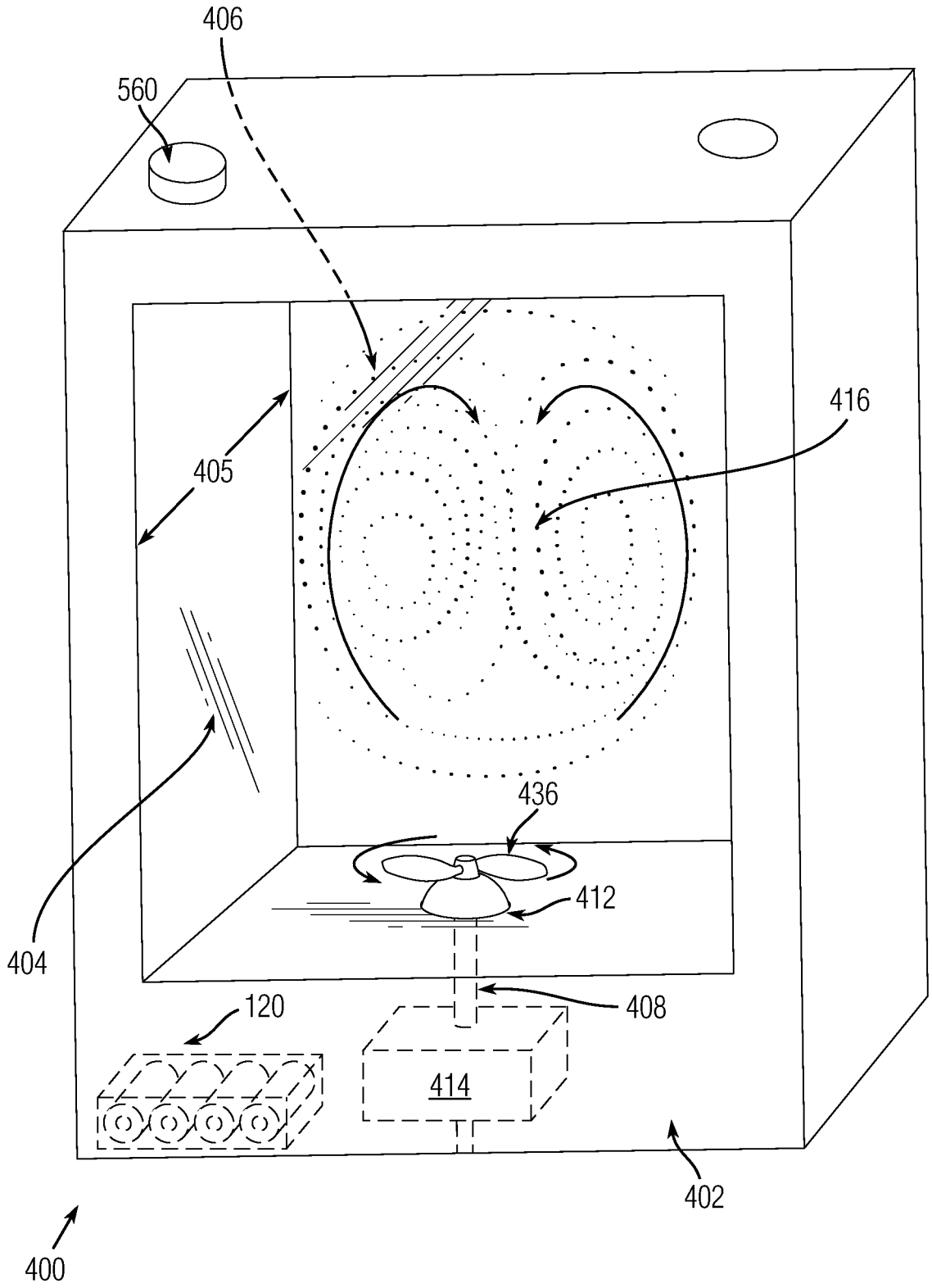
FIG. 4 is another perspective view of the illuminated novelty frame for displaying a feature in motion according to a fourth embodiment of the present invention.

FIG. 4 shows a shaft-actuated embodiment of a liquid-filled novelty frame 400 of the present invention. This arrangement can be used in both the "glitter storm" and "fish tank" embodiments of the invention previously described in connection with FIGS. 2 and 3. This embodiment now has the second end 412 of the shaft 408 opposite the motor 414 coupled to an impeller 436 positioned between the panels 404, 406 in the volume of liquid. When the impeller 436 is set in motion, it induces movement of a volume of liquid contained in the space 405 between the panels 404, 406. The motion of the impeller 436 creates currents in the liquid, resulting in a propulsive force on a feature 416 that is suspended in the liquid. The feature 416 can be the multiplicity of glitter particles shown in FIG. 4 or a freely-floating object, both referred to earlier in the discussion of embodiments with an air pump connected to at least one nozzle. The propulsive force and currents created by the impeller 436 are sufficient to keep the suspended glitter or object aloft against the force of gravity. In the case of a freely-floating object that is of lower density than the liquid between the panels 404, 406, an impeller 436 positioned near the top of the panels 404, 406 exerts a propulsive force to resist the upward force of buoyancy on the object.

Figure 5:
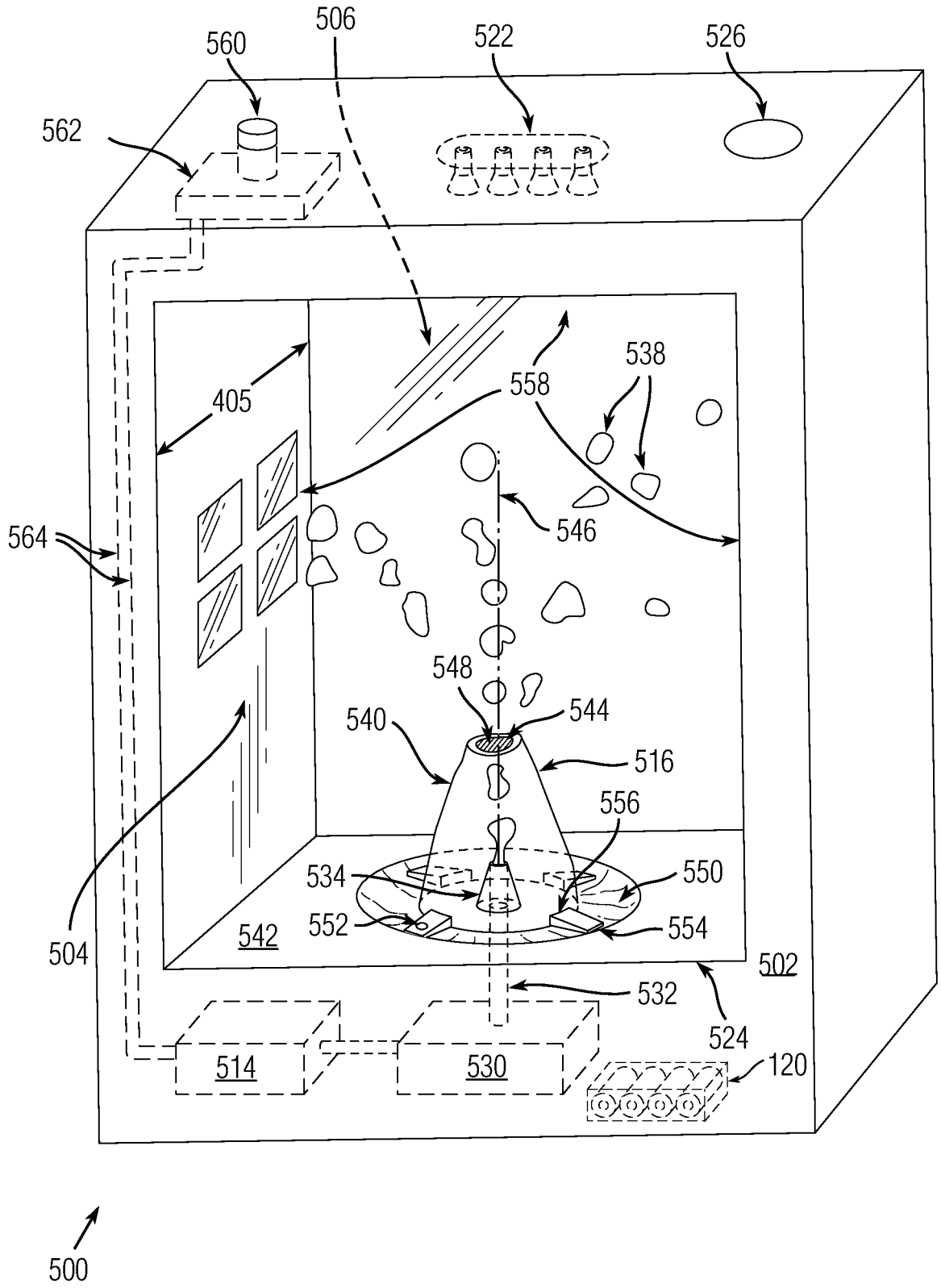
FIG. 5 is another perspective view of the illuminated novelty frame for displaying a feature in motion according to a fifth embodiment of the present invention.

FIG. 5 shows a further embodiment of the invention 500 having a feature 516 called "the volcano." This feature requires the introduction of a quantity of lava globules 538, which according to one embodiment take the form of a plurality of spheroid beads. The beads can be supplied in a package that is provided with the novelty frame, and can comprise an elastic, plastic, or rubber material. The beads are added by an end-user, for instance, to the space 505 between the panels 504, 506 through the port 526, along with a quantity of water. The beads can be shaped as perfect spheres, but they need only have rounded shapes and can be characterized by a plurality of diameters as measured in different directions. Injection molding is a suitable process by which to manufacture the beads because it provides sufficient quality control in creating spherical or substantially spherical beads. To simulate the fact that a volcanic eruption is a natural phenomenon, with variably and irregularly shaped and sized globules 538 of lava, the beads can be provided in a range of sizes. According to one embodiment, a first portion of the supplied beads is small, on the order of 1-2 mm. average largest dimension, a second portion of the supplied beads is medium-sized, having average largest dimension on the order of 2-3 mm., and a third portion of the supplied beads is relatively large, with largest dimension on the order of 3-5 mm. If the beads are spherical, then the largest dimension is the diameter of the beads. In an embodiment, fewer or additional bead sizes can be supplied with the frame.

A sloped, substantially conical projection 540 extends or rises from a base 542 disposed within the space 505 in the frame between the two panels 504, 506. The projection includes a mouth 544 disposed near its top to simulate the volcano's vent, which is the fissure that expels lava during an eruption. An air pump 530 is supported by the frame 502 and driven by the motor 514. The discharge from the air pump 530 is fluidly connected by a manifold 532 to at least one nozzle 534 which provides fluid communication between the air pump 530 and the liquid between the panels 504, 506. When the motor 514 is energized, the resulting air discharge delivered through the one or more nozzles 534 induces movement of the globules 538 suspended in the liquid. In this arrangement, the output stream of at least one nozzle 534 is positioned within the conical projection 540 and directed such that its output stream axis 546 or centerline extends through a point contained within the vent area 548, an area defined by the periphery of the mouth 544. If more than one nozzle 534 is disposed within the projection, they can be positioned such that the respective stream axes 546 extend through a variety of points within the vent area. The motor 514 is energized periodically after a user presses a power button 560 connected to a timing circuit 562. The timing circuit 562 is connected by electrical leads 564 to the motor 514, and when the timing circuit 562 is activated globules 538 are expelled during the on-phase of each duty cycle of the motor 514. A recessed catch basin 550 or a guide 552 within the frame conducts quantities of the globules 538 into the path of the one or more nozzles 534, causing the globules 538 to be expelled through the mouth 544 in a way that is reminiscent of a volcanic eruption. Eddy currents in the water are thereby created, which rise and then curve as the incompressible liquid encounters the upper wall of the space 505, turn back in a downward direction and serve to return the globules 538 to the base 542 where they can again be acted upon by the nozzles 534. For example, a nozzle 534 whose stream axis 546 extends through a point at the geometric center of the vent area 548 can simulate the effects of an explosive eruption that spews lava and ash into the atmosphere to high altitudes. Alternatively, the output stream from a nozzle 534 whose stream axis extends through a point in the vent area 548 near the periphery of the mouth 544 will experience significant interference or flow impedance, simulating the visual effect of lava drizzling down the flanks of the volcano. One nozzle 534 can be used, oriented to achieve the desired effect, or a plurality of nozzles 534 may be disposed within the projection 540 to achieve an effect that combines elements of both explosive eruption and flank drizzle. The catch basin 550 is positioned within the frame to collect the globules 538 as they fall within the volume of liquid under the influence of gravity, and it is formed to direct the collected globules 538 into the output stream of the at least one nozzle 534.

Even when a nozzle's 534 stream axis 546 is collinear with the geometric center of the vent area 548, some degree of flow impedance occurs. This is because some of the globules receive a nozzle thrust force that is collinear with the center of gravity, while other globules don't roll directly into the nozzle's path and thus experience an eccentric thrust force from the nozzle. The eccentrically-directed thrust force imparts a spin to the globules, resulting in an off-vertical trajectory that brings the globule into contact with the periphery of the mouth 544 as the globule exits the conical projection 540. This results in a perceptible auditory effect due to the impact of multiple beads with the mouth 544 of the conical projection 540 and with each other, along with the action of the water jet itself from the nozzle 534. The sound is a distinctive gentle "whoosh" that is pleasing and soothing. This gentle "whoosh" sound has a rhythmic, periodic quality corresponding to the duty cycle of the motor 514 that causes it to resemble respiration. As such, the sound has a calming effect on those who hear it.

An alternative source of propulsion for the globules is the use of a turbine or impeller 536 connected by a shaft 508 to the motor 514, an arrangement described in detail in the foregoing discussion of the fourth embodiment of the invention and shown in FIG. 4. The impeller is disposed within the conical projection 540 at the level of the base 542 and substantially centered under the mouth 544 so that the globules are expelled from the projection 540 by the action of the impeller without excessive interference from the edges of the mouth 544.

The base 542 is also preferably formed with a pitch or grade that will direct the globules under the influence of gravity toward the conical projection 540. One or more guides 552 can be positioned within the frame, each guide having a first end 554 and a second end 556 in fluid communication with the volume of liquid. The guide conducts globules 538 collected at the first end 554, on the level of the base 542 or in the catch basin 550, to the second end 556, whose output is directed into the output stream of the at least one nozzle 534 disposed within the projection 540. An arrangement that combines a catch basin 550 and one or more guides 552 is also possible. In this embodiment, the one or more guides 552 are connected in series between the catch basin 550 and the output stream of the at least one nozzle 534.

FIG. 5 also shows one possible light source 522 provided to illuminate the feature 516. The light source 522 is supported by the frame 502 and is positioned to illuminate the feature 516 from above to highlight the eruption of the volcano in this embodiment. The light source 522 in an embodiment is an LED array, but it can also be any other compact light source that is connectable to an electric power source, including a small incandescent bulb. Mirrors 558 are seated throughout the space 505, including at least the vertical sidewalls between the panels, to enhance and direct the illumination provided by light source 522 toward the feature 516.

Figure 6:
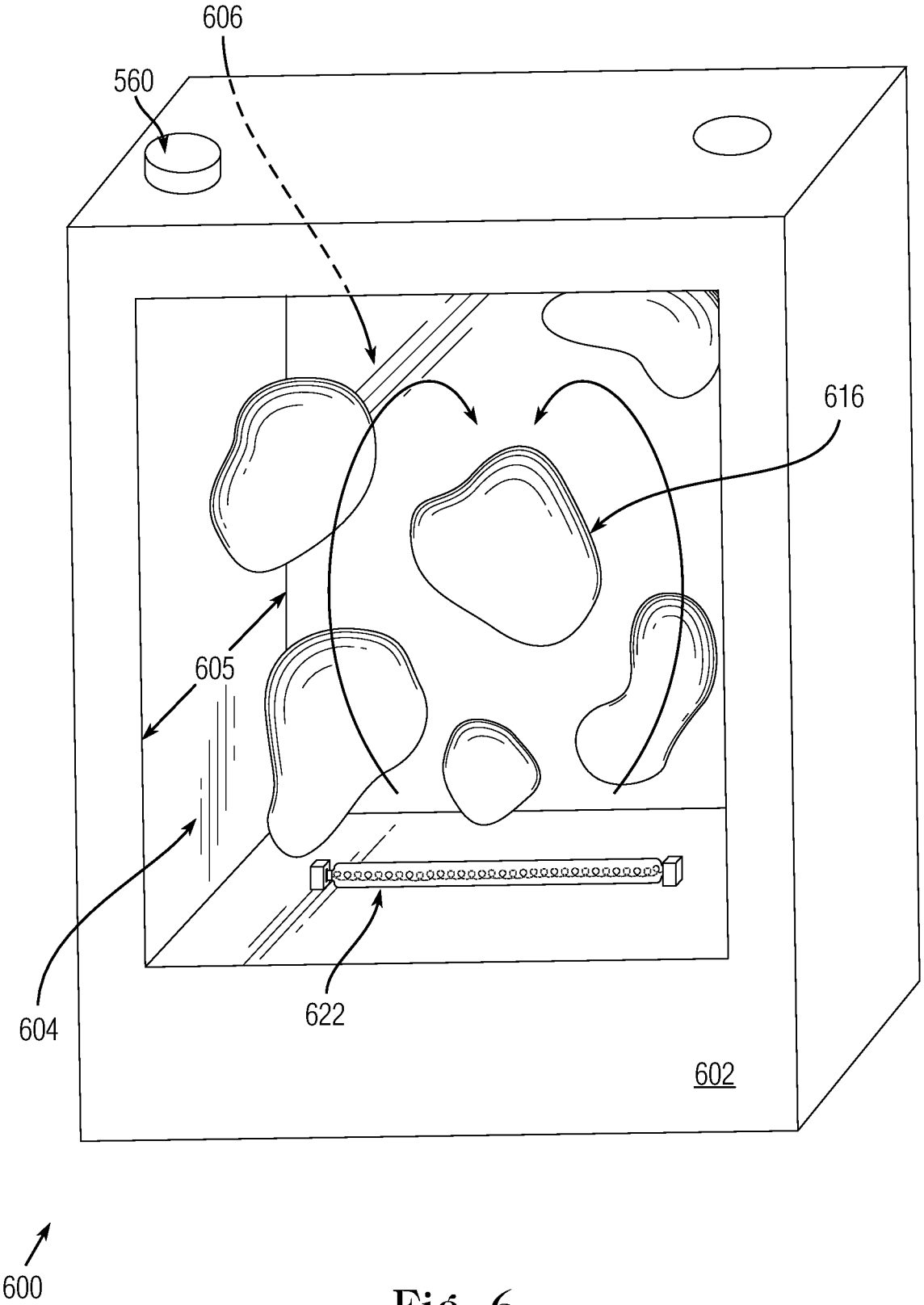
FIG. 6 is another perspective view of the illuminated novelty frame for displaying a feature in motion according to a sixth embodiment of the present invention.

FIG. 6 shows a further embodiment 600 that evokes a "lava lamp" within the geometry of the frame 602. A light source 622 is supported by the frame 602 and provides illumination and heating to cause movement of wax within an oil fluid. More particularly, the space 605 between the panels 604, 606 includes two immiscible substances. The first substance used to fill the space 605 between the panels 604, 606 can be oil. The second substance disposed in the space 605 can be one or more waxes, and when melted and moving throughout the space the wax constitutes the feature 616 of this embodiment. The light source 622 is mounted at least at the lower end of the space 605, while additional light sources can also be supported by the frame at other locations within the space 605. The light source 622 is chosen for its ability to provide illumination as well as its ability to generate and deliver sufficient heat energy to melt the wax such that it will flow immiscibly in the oil disposed within the space 605. The heating of the oil and wax will establish convection currents that cause the melted wax to rise and circulate throughout the oil-filled space 605.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An illuminated novelty frame for displaying a feature in motion, comprising:

a frame having a width and height of about 8 inches and a depth of around 1.5 to 2.0 inches;

two panels separated by a gap in the direction of the depth of the frame and seated within the frame, at least one panel being transparent, wherein each panel is supported by the frame at an interface;

a motor supported by the frame, wherein the motor is connectable to an electric power source to induce movement of the feature when energized;

a light source supported by the frame and oriented to illuminate at least the feature;

an air pump driven by the motor, the air pump fluidly connected to at least one nozzle having an output comprising an air stream to induce the movement of the feature when the motor is driven;

a plurality of elastic, spheroid globules comprising the feature, wherein the globules are moveable and visible between the two panels;

a sloped projection extending from a base disposed within the frame between the two panels and having a mouth disposed near the top of the projection, the mouth being in fluid communication with the output stream of the at least one nozzle; and a catch basin positioned within the frame to collect the globules as they fall within the volume of liquid under the influence of gravity, and wherein the catch basin is shaped to direct the collected globules into the output stream of the at least one nozzle, wherein the interface comprises a liquid-impermeable barrier and wherein the frame further includes a port for receiving a volume of liquid between the panels.

2. The illuminated novelty frame of claim 1, wherein the feature, while suspended in the liquid, is induced by action of the at least one nozzle fluidly connected to the air pump.

3. The illuminated novelty frame of claim 2, wherein the object has a different density than the liquid and whose motion, while suspended in the liquid, is induced by the action of the at least one nozzle fluidly connected to the air pump.

4. The illuminated novelty frame of claim 2, wherein the object has a greater density than the liquid and whose motion, while suspended in the liquid, is induced by the action of at least one nozzle, wherein the nozzle is fluidly connected to the air pump and disposed near a lower edge of the panels to inject air in an upward direction to oppose the downward movement of the object due to the force of gravity acting on the object.

5. The illuminated novelty frame of claim 1, further comprising:

at least one guide, having at least a first end and a second end, each in fluid communication with the volume of liquid, wherein the guide conducts globules collected at the first end, on the level of the base or in the catch basin, to the second end, whose output is directed into the output stream of the at least one nozzle.

6. The illuminated novelty frame of claim 5, wherein the guide is connected in series between the catch basin and the output stream of the at least one nozzle.

7. The illuminated novelty frame of claim 1, wherein one of the panels has a reflective surface.

8. The illuminated novelty frame of claim 1, further comprising a printed overlay disposed on at least one of the panels.

9. The illuminated novelty frame of claim 1, wherein the frame defines an aperture which is centrally located with respect to the width of the frame and sized to receive a picture frame hanger.

10. The illuminated novelty frame of claim 1, wherein the frame has vertical interior sidewalls extending in the direction of the height between the two panels, the frame further comprising a mirror included along at least one vertical interior sidewall to direct the illumination provided by light source toward the moveable feature.

* * * * *